US005992770A

United States Patent [19]

Culpepper

[11] Patent Number: 5,992,770

[45] Date of Patent: Nov. 30, 1999

[54] BURNER FOR GRILL AND METHOD FOR MAKING SAME

[76] Inventor: J. Manning Culpepper, 801 Cooper Ave., Columbus, Ga. 31906

[21] Appl. No.: 09/160,254

[22] Filed: Sep. 23, 1998

[51] Int. Cl.[6] ..... B05B 1/00; A47J 37/00; B23P 25/00

[52] U.S. Cl. ..... 239/548; 239/600; 29/458; 29/460; 29/890.02; 126/41 R

[58] Field of Search ..... 239/563, 548, 239/600; D26/114; 29/458, 460, 463, 890.02; 126/41 R, 19 R

[56] References Cited

U.S. PATENT DOCUMENTS

| | | | |
|---|---|---|---|
| 621,248 | 3/1899 | Heller | 239/548 X |
| 1,064,314 | 6/1913 | German | 239/548 X |
| 4,267,816 | 5/1981 | Koziol | 126/41 R |
| 4,305,372 | 12/1981 | Hahn | 126/41 R |
| 4,986,254 | 1/1991 | Haen et al. | 126/41 R |
| 5,249,958 | 10/1993 | Freber | 126/41 R X |
| 5,711,663 | 1/1998 | Giebel et al. | 126/41 R X |

*Primary Examiner*—Andres Kashnikow
*Assistant Examiner*—Robin O. Evans
*Attorney, Agent, or Firm*—James B. Middleton

[57] ABSTRACT

A burner for a gas grill is inexpensive and durable. The burner may be made of an inexpensive sheet steel, but the steel is fully porcelainized or otherwise treated to resist corrosion. The complete coverage of the porcelain is accomplished by making the burner in two halves, and porcelainizing all surfaces of the two halves. The two halves are subsequently assembled into a single burner. Each half has flanges extending therefrom, and a channel engages the flanges to hold them together. Screws or other fastening means can be used to secure the channel to the flanges. In one embodiment of the invention the channel is integrally formed with one of the burner halves. One or both halves of the burner may also be made of a durable metal without the anticorrosive treatment.

12 Claims, 1 Drawing Sheet

BURNER FOR GRILL AND METHOD FOR MAKING SAME

BACKGROUND OF THE INVENTION

1. Field of the Invention

This invention relates generally to gas burners, and is more particularly concerned with an improved burner for a gas grill, and a method for making the burner.

2. Discussion of the Prior Art

The burner in a gas grill, such as a barbecue grill, operates in an extremely difficult environment, in that the burner is subject to repeated heating and cooling. Along with the extreme changes in temperature, the burner is subject to high moisture, corrosive salts, and other items used in coking on the grill.

The interior of the burner is subject to the heating, cooling and moisture to which the outside is subject; plus, the interior of the burner is exposed to the corrosive action of acids that form from the gases used for combustion. Thus, both the inside and the outside of the burner are exposed to highly deleterious environments that cause corrosion of the material from which the burner is made.

There are many forms of burners for gas grills, including burners of cast iron, brass or the like. These are good burners, but are heavy, and expensive to manufacture; additionally, it is difficult to keep the gas ports open so the burners are somewhat difficult to maintain.

Burners are also made of sheet steel, whether stainless steel or other steels. Stainless steel of course lasts longer, but is considerably more expensive. Other steels are inexpensive, but the life in the environment of a grill is very short.

One recent effort at solving the problems of cost and life of a burner has been to fabricate the burner as two halves, the burner being made of inexpensive sheet steel, such as a zero carbon steel. The halves are assembled by hemming a flange of one over a flange on the other; then, the exterior of the burner is porcelainized for longer life. While this may be an improvement, the burner suffers from the fact that the interior is not porcelainized, so the interior is still subject to the corrosive action mentioned above. Those skilled in the art will understand that the interior cannot be porcelainized because the assembly technique cannot be used once the metal has been covered with porcelain. One prior art technique allows porcelainizing of a burner inside and outside after assembly, but that process is expensive and labor intensive. Other prior art burners have been made in two halves and spot welded together; but, this is not possible after porcelainizing because the porcelain does not conduct electricity. Thus, the prior art has not provided an inexpensive and durable burner for gas grills.

SUMMARY OF THE INVENTION

The present invention provides a burner for a grill, wherein the burner is fabricated in two separate halves, the halves are porcelainized or otherwise treated, and the two halves are assembled. The preferred method of assembly is to utilize a channel to receive appropriate flanges for securing the halves together; and, fastening means such as screws, rivets or the like can render the connection permanent.

The preferred embodiment of the invention comprises two halves of a burner stamped or otherwise formed of sheet steel, and having peripheral flanges. In this form, the burner halves are porcelainized or otherwise treated to resist corrosion; then, the burner halves are assembled, with the flanges juxtaposed on each other. A locking member, in the form of a channel or the like, engages both flanges to hold the flanges together, and screws or other fastening means pass through the locking means and the flanges to secure the burner halves.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
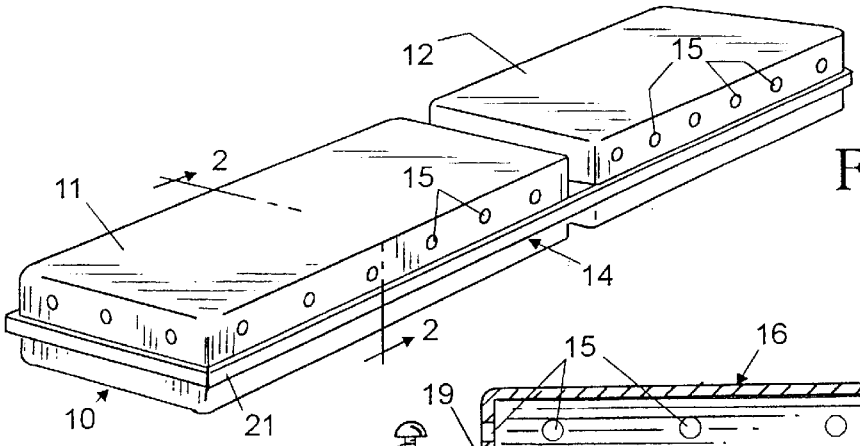
FIG. 1 is a perspective view of a burner for a gas grill made in accordance with the present invention.

Referring now more particularly to the drawings, and to those embodiments of the invention here presented by way of illustration, FIG. 1 shows a burner generally designated at 10, and having two sections 11 and 12 as is common for gas grills. Those skilled in the art will understand that there may be a separate gas jet for each of the sections 11 and 12, so only one half of the grill may be heated at one time if desired. The burner 10 is formed of two halves, an upper and lower half, fixed together by the locking means 14. As here shown, the upper half of the burner defines a plurality of holes 15 from which the gas exits. It will be understood that the holes 15 may be closer together or farther apart, and may be larger or smaller, depending on the specific burner design. Furthermore, the holes may be in the lower half of the burner rather than the upper; or, one might have holes in both halves, depending on the design.

Figure 2:
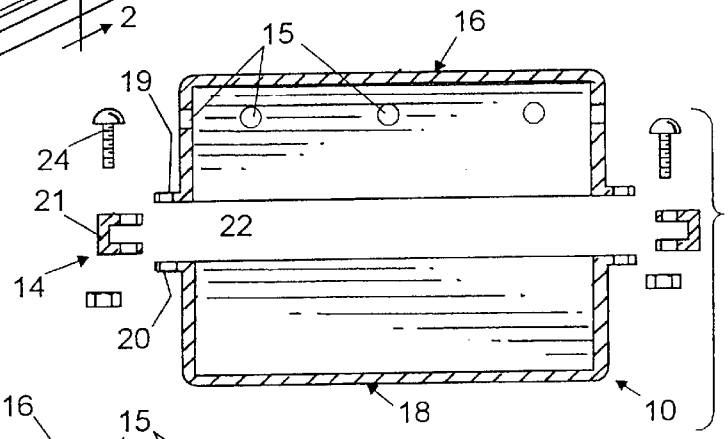
FIG. 2 is an enlarged, exploded cross-sectional view taken along the line 2—2 in FIG. 1 of the drawings.

The detailed construction of the burner 10 can be seen in FIG. 2 of the drawings. The burner 10 is shown as the two halves 16 and 18, the burner half 16 being the top, or upper portion, and the burner half 18 being the bottom, or lower portion. These burner halves may be stamped or otherwise formed in a conventional manner, and the precise shape can be varied considerably. The important feature of the burner halves 16 and 18 is the outwardly extending flanges 19 on the upper half, and 20 on the lower half. The upper flange 19 will be juxtaposed on the lower flange 20, and held in that position by the locking means 14.

The locking means 14 is here shown as comprising a channel 21. The opening 22 in the channel will be sized to receive the flanges 19 and 20 snugly so the burner halves will be held tightly together. As here shown, the flanges 19 and 20, and the channel 21, define holes therein so the channel 21 can be fixed in place by a plurality of screws 24 or the like. Any suitable fastening means may be used.

It will be understood by those skilled in the art that, if the bare metal burner halves 16 and 18 are fixed together, many different locking means may be utilized, including hemming the sheet material, welding, spot welding and the like. In the present invention, however, the burner halves as shown in FIG. 2 will be porcelainized, so the porcelain coating will cover all surfaces. This is desirable because the porcelain coating protects both the interior and exterior surfaces of the burner from corrosive influences; but, once the metal is covered with porcelain, the sheet metal can no longer be hemmed to connect the halves, and welding, spot welding and the like are not possible because the metal is no longer exposed. Additionally, it is easier or keep the gas exit holes open when porcelainizing separate sections of a burner. It is of course very important to maintain fully open holes to have uniform flame distribution.

The present invention therefore comprises the steps of forming a plurality of burner portions, treating the separate burner portions to prevent corrosion, then assembling the burner portions into a complete burner, and utilizing a locking means for holding the portions together. The preferred embodiment of the invention utilizes flanges on each of the burner portions, and a channel to secure two flanges together. Fastening means may be used to hold the channels to the flanges.

Since the burner is porcelainized in two separate parts, the parts can be spray coated with the porcelain frit, or powder coated with frit. Either of these processes allows better quality control in keeping the holes open than the conventional process of dipping the parts into a slurry of porcelain frit. The best results are obtained by powder coating the individual halves of the burner, inside and out, then firing the pieces. This cannot be done after the burner has been assembled.

Figure 4:
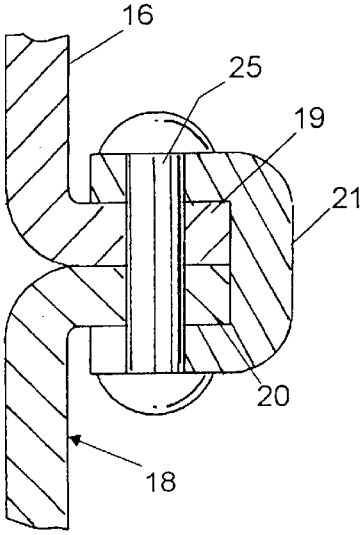

FIG. 4 of the drawings in an enlarged cross-sectional view showing the flanges 19 and 20 held together by a channel 21. The fastening means shown in FIG. 4 is a rivet 25; but, as is discussed above, any similar fastening means may be utilized to secure the channel 21 to the flanges 19 and 20.

Figure 3:
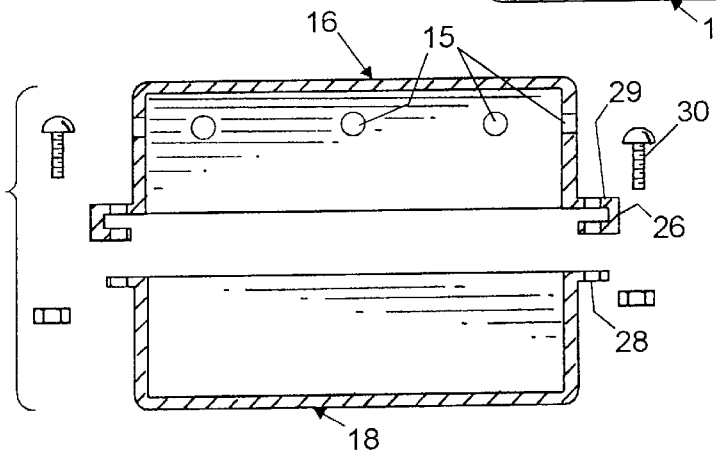
FIG. 3 is a view similar to FIG. 2, but showing a modification of the burner; and, FIG. 4 is a fragmentary, highly enlarged detail showing one form of locking means.

A somewhat different embodiment of the present invention is shown in FIG. 3 of the drawings. The burner halves are the same as those previously discussed, so they carry the same reference numerals. The difference in the embodiment of FIG. 3 is in having the channels 26 of the locking means 14 formed integrally with one of the burner halves, here shown as the upper half 16.

As in the previously described embodiment, the burner halves 16 and 18 will be formed from sheet steel, then each of the burner halves will be fully coated with porcelain, or otherwise treated to resist corrosion. After the treatment, the flange 28 of the lower half 18 will be slid longitudinally into the channel 26, placing the flange 28 against the flange 29. Screws 30 or the like will secure the two halves.

When using an arrangement as shown in FIG. 3 of the drawings, it will be understood that the integrally formed channel 26 cannot be used on the ends of the burner. To secure the ends, therefore, one might provide flanges as in FIG. 2, and use a separate channel or other locking means to close the end of the burner securely.

The present invention further contemplates the use of other metals for the burner of the present invention, with or without the porcelain or other treatment. For example, the top may be made of stainless steel, brass or other durable metal, and the bottom porcelain; or, the top may be porcelain, and the bottom stainless steel, brass or the like. Many other combinations such as these will suggest themselves to those skilled in the art.

It will therefore be seen that the present invention provides a burner for a grin, wherein the burner may be made of inexpensive sheet steel, and is coated both inside and outside to resist corrosion. The burner is formed in two half-burners, and each of the two halves may be fully coated with porcelain, or other material. After the halves are coated, the two are assembled. Outwardly extending flanges on each half are juxtaposed, and locked in that condition as by a channel. The channel may then be fixed in place by fastening means such as screws, rivets or the like.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

What is claimed as invention is:

1. A method for making a burner for a grill, said method comprising the steps of forming a plurality of burner portions so that said portions can be assembled into a burner for a grill, treating all surfaces of each of said plurality of burner portions to resist corrosion, then assembling said plurality of burner portions to form a burner for a grill, the said step of assembling said plurality of burner portions comprising the steps of juxtaposing flanges on contiguous portions, and holding said flanges together with a channel.

2. A method as claimed in claim 1, wherein said plurality of burner portions consists of a pair of burner halves comprising an upper half and a lower half, each of said burner halves including flanges extending therefrom, said upper half defining a plurality of holes therein as gas exit ports, and wherein said step of juxtaposing flanges on contiguous portions consists of juxtaposing the flanges of said upper half on said flanges of said lower half.

3. A method as claimed in claim 2, wherein said step of holding said flanges together with a channel consists of the step of placing the channel over the juxtaposed flanges of said upper and lower halves.

4. A method as claimed in claim 3, wherein said flanges and said channel define holes therein, and further including the step of passing fastening means through said holes in said flanges and channel for securing said channel in place over the flanges.

5. A method as claimed in claim 4, wherein said channel is integrally formed with one of said burner halves.

6. A method as claimed in claim 5, wherein said step of treating all surfaces of each of said plurality of burner portions to resist corrosion consists of porcelainizing said surfaces.

7. A burner for a gas grill, said burner comprising an upper burner half defining a plurality of holes therein as gas exit ports, and flanges extending therefrom, said burner half having an interior surface and an exterior surface, both said interior and exterior surfaces being treated to resist corrosion, and a lower burner half, said lower burner half including flanges extending therefrom, said lower half having an interior surface and an exterior surface, both said interior and exterior surfaces being treated to resist corrosion, said flanges on said upper half being juxtaposed on said flanges on said lower half; and locking means for holding said flanges of said upper half against said flanges on said lower half.

8. A burner as claimed in claim 7, wherein said locking means comprises a channel engaging said flanges for holding said flanges together.

9. A burner as claimed in claim 8, wherein said channel is integrally formed on said upper burner half.

10. A burner as claimed in claim 8, and further including fastening means for securing said channel to said flanges.

11. A burner as claimed in claim 10, wherein said treatment to resist corrosion consists of a coating of porcelain.

12. A burner as claimed in claim 10, wherein said treatment to resist corrosion consists of making said burner halves of a metal selected from the group consisting of stainless steel and brass.

* * * * *